US005475199A

United States Patent [19]

Buchanan

[11] Patent Number: 5,475,199

[45] Date of Patent: Dec. 12, 1995

[54] PLANAR ELECTRIC HEATER WITH ENCLOSED U-SHAPED THICK FILM HEATING ELEMENT

[76] Inventor: R. Craig Buchanan, 40730 Foxboro Ct., Bass Lake, Calif. 93604

[21] Appl. No.: 172,885

[22] Filed: Dec. 22, 1993

[51] Int. Cl.[6] ..... H05B 3/02

[52] U.S. Cl. ..... 219/243; 219/543; 156/579

[58] Field of Search ..... 219/243, 245–259, 219/543, 544, 541, 221, 536; 338/326, 307–309, 322; 38/74, 82; 156/579

[56] References Cited

U.S. PATENT DOCUMENTS

| | | | |
|---|---|---|---|
| 729,369 | 5/1903 | Lowenthal | 219/254 |
| 916,994 | 4/1909 | Carpenter et al. | 219/254 |
| 1,150,428 | 8/1915 | Hadaway, Jr. | 219/245 |
| 1,158,557 | 11/1915 | Rose | 219/254 |
| 2,249,600 | 7/1941 | Bryan | 219/243 |
| 2,913,564 | 11/1959 | Tavender et al. | 219/254 |
| 3,651,305 | 3/1972 | Shimota | 219/243 |
| 3,711,678 | 1/1973 | Kuus | 219/227 |
| 3,808,573 | 4/1974 | Cappell | 338/249 |
| 4,108,713 | 8/1978 | Weisz | 156/499 |
| 4,571,482 | 2/1983 | Vogel | 219/237 |
| 4,584,040 | 4/1986 | Anderson | 156/579 |
| 4,859,835 | 8/1989 | Balderson | 219/543 |
| 5,081,340 | 1/1992 | Levitan | 219/469 |
| 5,294,284 | 3/1994 | Papulski | 156/574 |

FOREIGN PATENT DOCUMENTS

| | | | |
|---|---|---|---|
| 28539 | 9/1921 | Denmark | 219/254 |
| 201967 | 11/1986 | European Pat. Off. | 219/251 |
| 543582 | 9/1922 | France | 219/254 |
| 2691723 | 12/1993 | France | 219/252 |
| 3409925 | 9/1985 | Germany | 219/254 |
| 413980 | 6/1946 | Italy | 219/254 |
| 69902 | 10/1914 | Switzerland | 219/254 |
| 127993 | 8/1959 | U.S.S.R. | 219/254 |
| 1085784 | 10/1967 | United Kingdom | 219/254 |

*Primary Examiner*—John A. Jeffery

[57] ABSTRACT

An electric heater assembly (16) adaptable for battery operation with hand held devices for attaching, sealing or shrinking heat activated plastic or mylar film materials includes a heating element (20) comprising a planar electrically insulating substrate (18) having a heating element (20) being a thick film conductor delineated and fired on one of its planar surfaces in a configuration that realizes local high power density in the heating element and the resultant production of localized high heat energy within the substrate with minimized power consumption from an external electrical source. Enclosing the heater assembly is a sheet metal sheath (24) to provide mechanical protection and to effect heat transfer to a work. The heater assembly is positioned, with the heating element facing up, inside the sheath with its opposing surface atop of, and in intimate contact with, a planar base (24*a*) of the sheath, a workface (26) comprising an opposing side of the base.

2 Claims, 5 Drawing Sheets

35
35'
23
22
32
32'
34
34'
28
18b
30
29
20
18
31
16
18a
24c
24e
24d
24a
24b
26
24

PLANAR ELECTRIC HEATER WITH ENCLOSED U-SHAPED THICK FILM HEATING ELEMENT

BACKGROUND—FIELD OF INVENTION

This invention relates to heater assemblies comprising thick film electrical conductors formed on electrically insulated substrates to provide local high power density with minimized power consumption from an external electrical source and it also relates to the reduction of heat loss from the heater assemblies to the surroundings through other than a workface.

BACKGROUND—DESCRIPTION OF PRIOR ART

Applicant is unaware of any electric heater assemblies adapted for use in hand held heat attaching, sealing, or shrinking devices for heat activated plastic or mylar film materials using a thick film conductor on an electrically insulating substrate to provide local high power density with resultant high heat energy supplied to a work with minimized power consumption from an external electrical source in a manner that reduces heat loss to surroundings through other than a workface.

Heater assemblies for attaching, sealing or shrinking of heat activated plastic or mylar films such as are used for covering model aircraft are well known and typically consist of metal resistance ribbon or wire wrapped around a planar piece of insulating material and placed in a metal shoe which utilizes the sole of the shoe as a workface. The ends of the ribbon or wire are connected to terminals which, in turn, are connected to an external electrical source. Due to the necessity of providing an air gap between the heater assembly and the shoe in order to electrically isolate the heating element there is no intimate contact between the heater assembly and the shoe resulting in substantial reduction in heating efficiency. In addition this construction results in a bulky device requiring unnecessary expenditure of electrical energy, thus precluding direct current, or, more specifically, battery operation. Alternate approaches in which heater assemblies housing a resistance element sandwiched between layers of insulating material all encased in a metal enclosure are also known as shown in U.S. Pat. Nos. 3,808,573, in 4,571,482, and 5,081,340. A heating unit comprising a thick film heating element and sensor is described in U.S. Pat. No. 4,859,835 in which the intrinsic temperature coefficient of resistivity of the thick film material is utilized to limit the power input to the heating element by means of a control circuit. None of these inventions, however, are adapted for use as the tool portion of a hand held, low power consumption heat attaching, sealing or shrinking device for heat activated plastic or molar films, nor do they disclose my heater assembly of thick film conductor on an electrically insulating substrate formed and disposed in a configuration that results in local high power density, highly efficient heat transfer to a workface, reduced heat loss from within the heater assembly, and reduced power consumption from an external electrical source thus making possible the use of direct current or battery powered, as well as alternating current electrical sources.

OBJECTS AND ADVANTAGES

It is therefore the primary object of this invention to provide an electrical heater assembly adapted to be used in battery powered, portable hand held devices for attaching, sealing or shrinking heat activated plastic or mylar films.

It is another object of the present invention to provide a heater assembly comprising a thick film conductor delineated and fired on an electrically insulated substrate in a configuration that produces local high power density and efficient heat transfer through a workface and minimizes power consumption from an external electrical source thus rendering possible the use of direct current and battery powered, as well as alternating current electrical sources.

It is a further object of the present invention to provide a heater assembly that reduces heat loss from within said heater assembly through surroundings other than a workface.

It is yet another object of the present invention to provide a heater assembly which combines simplicity and durability but yet is inexpensive in construction.

These and other objects will in part be obvious and in part pointed out in the following description and accompanying drawings which are merely illustrative of the present invention.

The foregoing objects are obtained by providing a heater assembly comprising a heating element being a thick film conductor pattern delineated and fired on one planar surface of a planar electrically insulating substrate formed in a configuration that realizes local high power density in the conductor, with the resultant production of localized high heat energy within the substrate, with minimized power consumption from an external electrical source. Enclosing the heater assembly is a sheath made of sheet metal such as stainless steel to provide mechanical protection and efficient heat transfer from the heater assembly through a workface which comprises a planar undersurface of the sheath. Also partially enclosed within the sheath is a dielectric mounting body having low thermal conductivity for:

(a) aiding in maintaining proper position of the heater assembly and sheath; and (b) serving as a mount for electrical contacts and external wire connections; and (c) reducing heat loss through surroundings other than the workface; and (d) providing a means of attaching the heater assembly and sheath to a device handle.

A simple spring wire latch connecting a rear side of the sheath to the handle is provided for securing the sheath in position.

DRAWING FIGURES

FIG. 1 is a perspective view of the enclosure of my low power sealer connected to a handle, FIG. 2 is an exploded view of the heater assembly, sheath, elements and mounting body in the preferred embodiment, FIG. 3 is a cutaway view of the heater assembly and mounting body, FIG. 4 is a plane view of the heater assembly, and FIG. 5 is a perspective view taken from outside the right rear of the sheath and distal end of the handle.

DESCRIPTION OF THE PREFERRED EMBODIMENT—FIGS. 1 THROUGH 5

Figure 1:
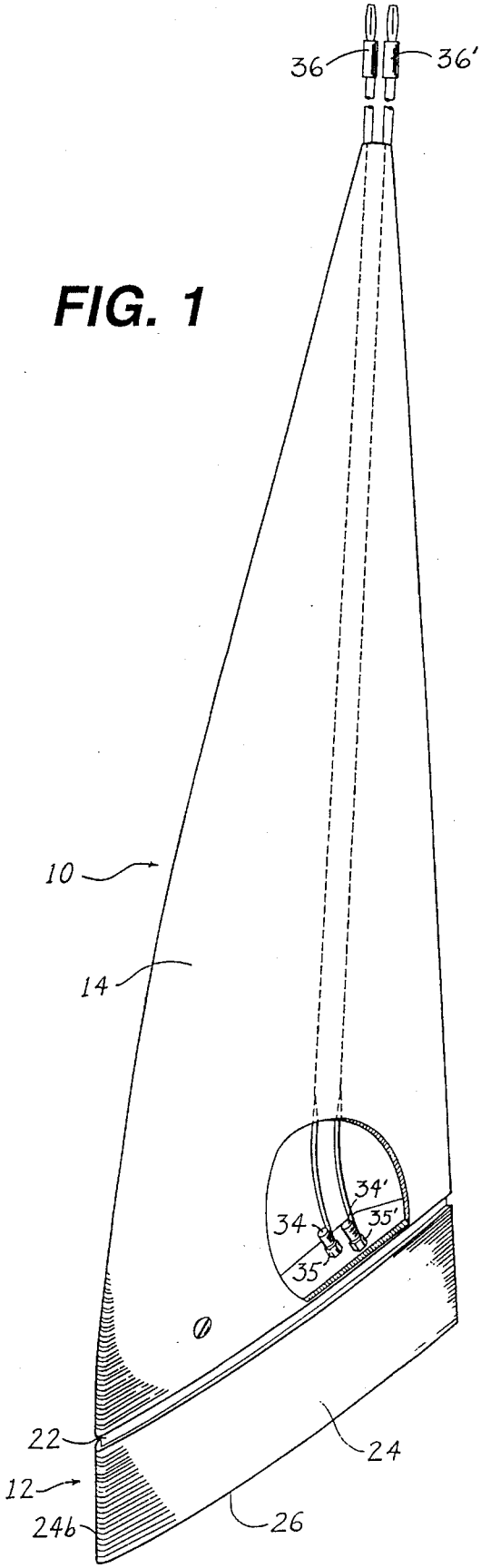

Referring now to the drawings where like characters of reference indicate like elements in each figure, 10 indicates generally, as shown in FIG. 1, a heat attaching, sealing, and shrinking device for heat activated plastic or mylar films with an electric heater assembly 12 of my low power sealer held by a mounting body 22 which is attached to a handle 14, the mounting body 22 having a pair of terminal screws 34 and 34' secured by two nuts 35 and 35' connected to a pair of external leads 36 and 36'.

Figure 2:
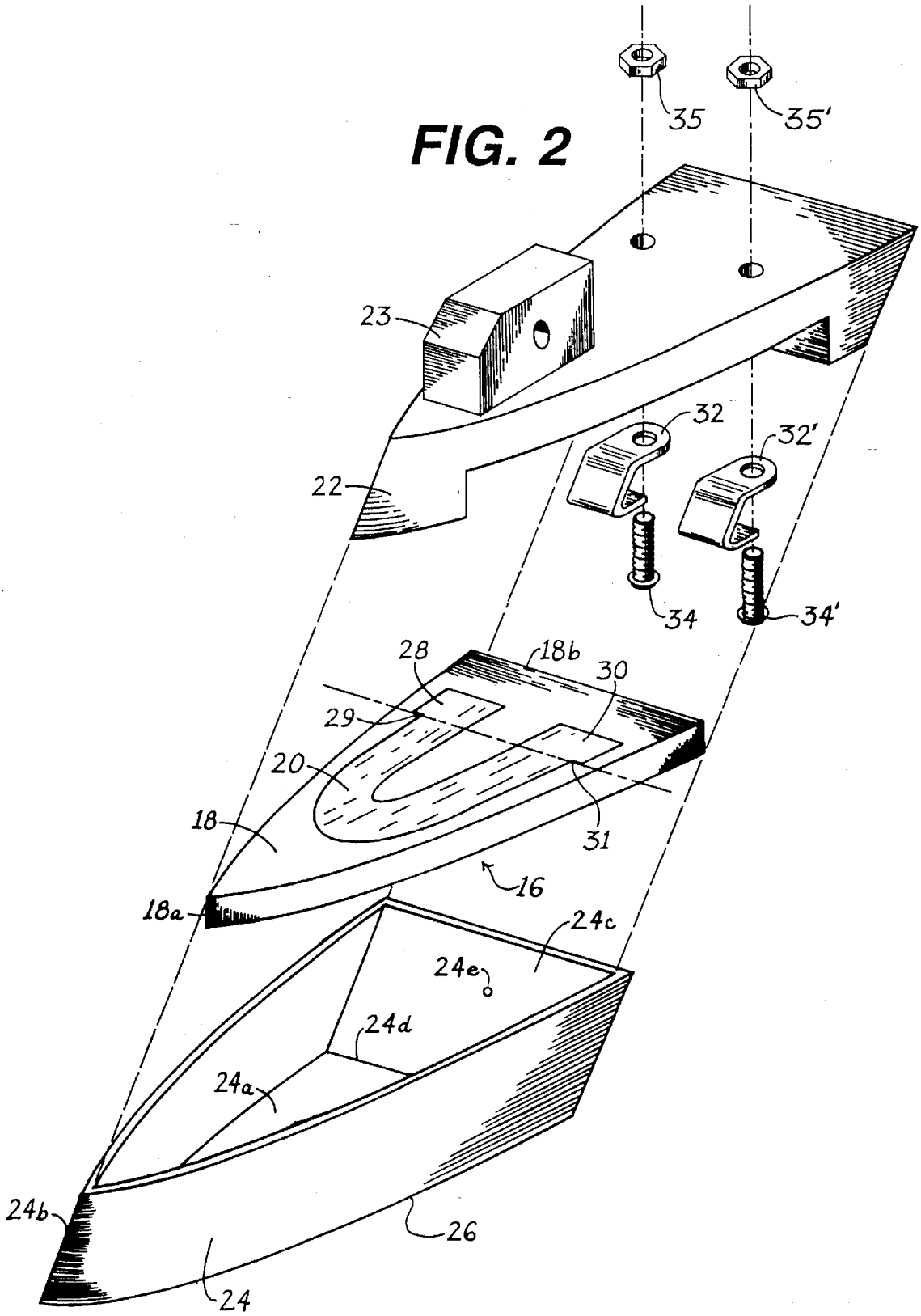

As shown in FIG. 2, the enclosure 12 includes a heater assembly 16 and a sheet metal sheath 24.

Figure 4:
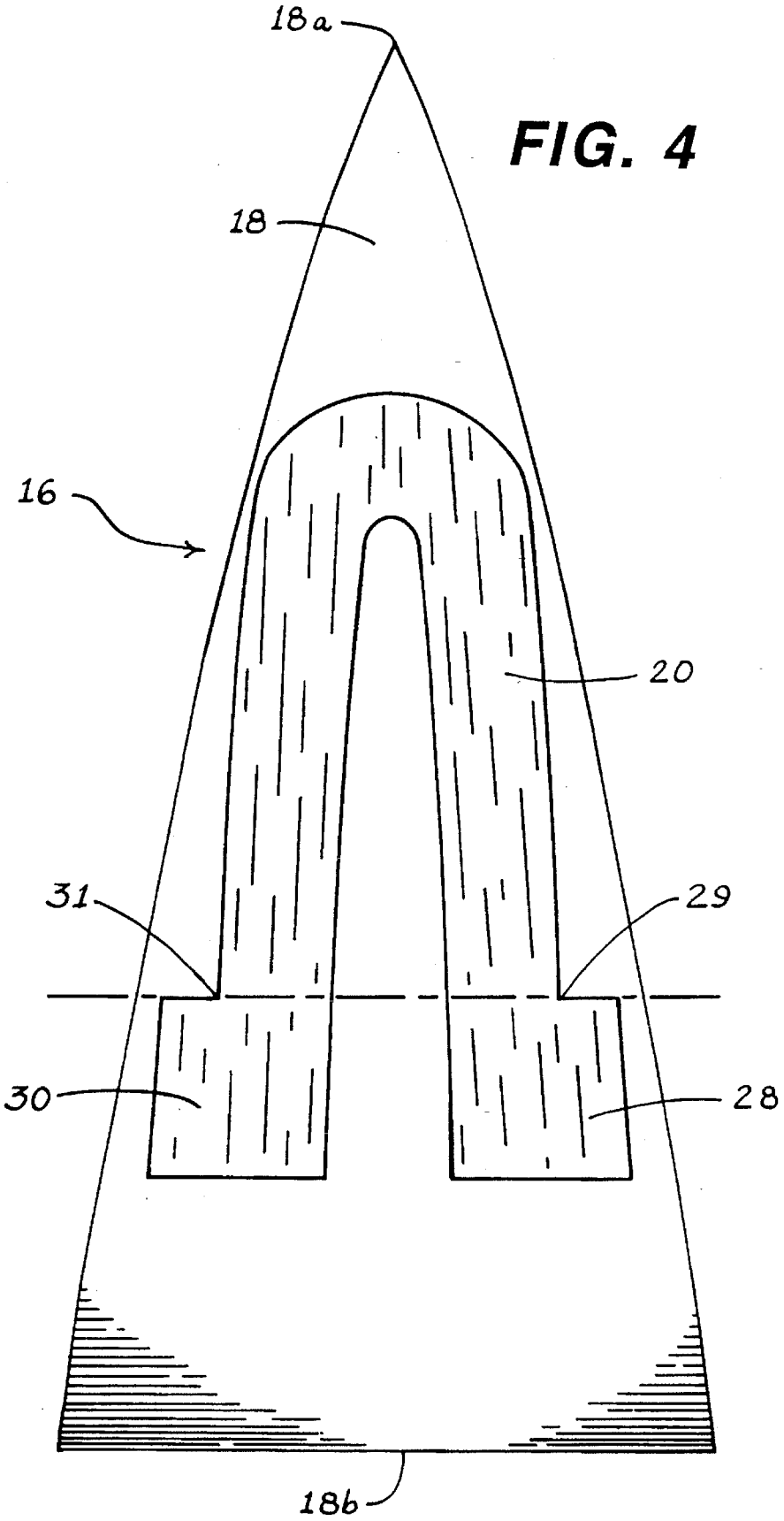

The heater assembly 16 comprises a planar dielectric clad metal substrate 18, in the shape of an isosceles triangle with an elongated altitude and slightly convex curved equal sides as best seen in FIG. 4. The substrate 18 has a frontal point 18*a* and a trailing edge 18*b* corresponding respectively to a vertex and an opposing base of the isosceles triangle. Delineated and fired in a U-shaped pattern on an upper planar surface of the substrate 18 is a heating element 20 comprising a thick film conductor with two enlarged conductor contact pads 28 and 30. The contact pads 28 and 30 extend from points 29 and 31 respectively to a terminus of each U-leg of the heating element 20 with the termini proximal to the trailing edge 18*b* of the substrate 18. The particular operating characteristics of the heating element 20 and the functions of the contact pads 28 and 30 will be more fully described later.

Figure 3:
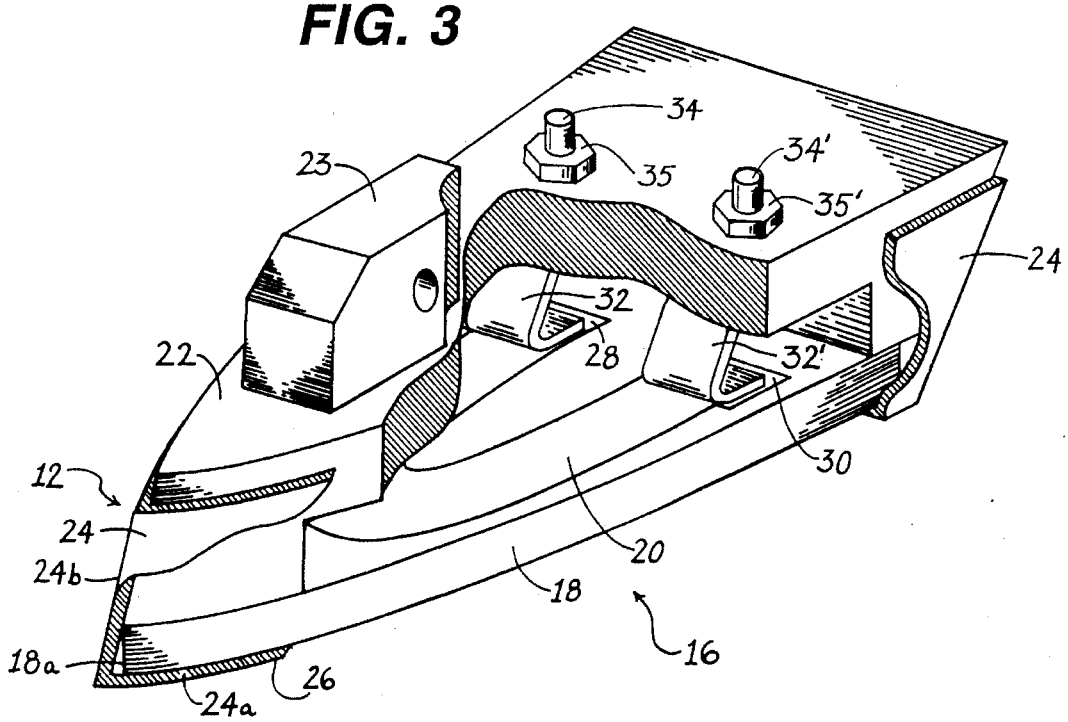

As can be seen in FIG. 2 and FIG. 3 the heater assembly 16, with the heating element 20 face up, is enclosed inside the sheet metal sheath 24 atop of, and intimate contact with, a planar horizontal base 24*a* of the sheath 24. The configuration and dimensions of the upper surface of the base 24*a* are similar to and with dimensions slightly larger than the substrate 18 to permit proper positioning of the substrate 18. A workface 26 comprises the undersurface of the base 24*a* of the sheath 24. The sheath 24 has three upstanding sides of equal height, with two of the sides, being equal in length, intersecting and mutually terminating at one each of their ends to form a leading edge 24*b* of the sheath 24 immediately ahead of the frontal point 18*a* of the substrate 18. A third, rear side 24*c* of the sheath 24 rises from a trailing edge 24*d* of the base 24*a* and mutually terminates with each of the two sides of equal length at their opposing ends from the leading edge 24*b*. Both the leading edge 24*b* and the rear side 24*c* of the sheath 24 are swept back at identical angles relative to the frontal point 18*a* of the substrate 18 and the trailing edge 24*d* of the base 24*a*. Means, for attaching the heater assembly 16 and the sheath 24 to the handle 14, and, to aid in making external electrical connections are provided by a mounting body 22 formed from insulating material of low thermal conductivity. The mounting body 22, with its lower portion contoured to form fit within the sheath 24 atop the heater assembly 16, has a planar horizontal upper surface with a mounting tongue 23 projecting from said upper surface above the enclosure of the sheath 24, the tongue 23 fitting into a recessed distal end (not shown) of the handle 14. The lower portion of the mounting body 22 serves in part to maintain proper positioning of the heater assembly 14 with the mounting body 22. The underside of the mounting body 22 is recessed in order to (a) minimize physical contact with the heater assembly 16 thus reducing heat loss, and (b) accommodate a pair of sheet metal conductor contacts 32 and 32' made of leaf spring material such as phosphorous bronze, and (c) avoid physical contact with the heating element 20 excepting upon the conductor contact pads 28 and 30 by the conductor contacts 32 and 32'. As can be seen in FIG. 2 and FIG. 3 the contacts 32 and 32' are bent near both of their ends in a manner to allow attachment to the mounting body 22 and to make electrical contact with contact pads 28 and 30. The attachment of the conductor contacts 32 and 32' to the mounting body 22 is accomplished by inserting a pair of terminal screws 34 and 34' through holes in one end of the conductor contacts 32 and 32' and in the recessed underside of the mounting body 22 and securing on the opposing upper surface of the mounting body 22 by two nuts 35 and 35'. The unattached ends of the contacts 32 and 32' are bent to align and make electrical contact in registry with conductor contact pads 28 and 30. As shown in FIG. 1 the terminal screws 34 and 34' and nuts 35 and 35' are connected to the external leads 36 and 36' as previously mentioned, through a recessed distal end, through an internal cavity, and, through an opening in a proximal end of the handle 14.

Figure 5:
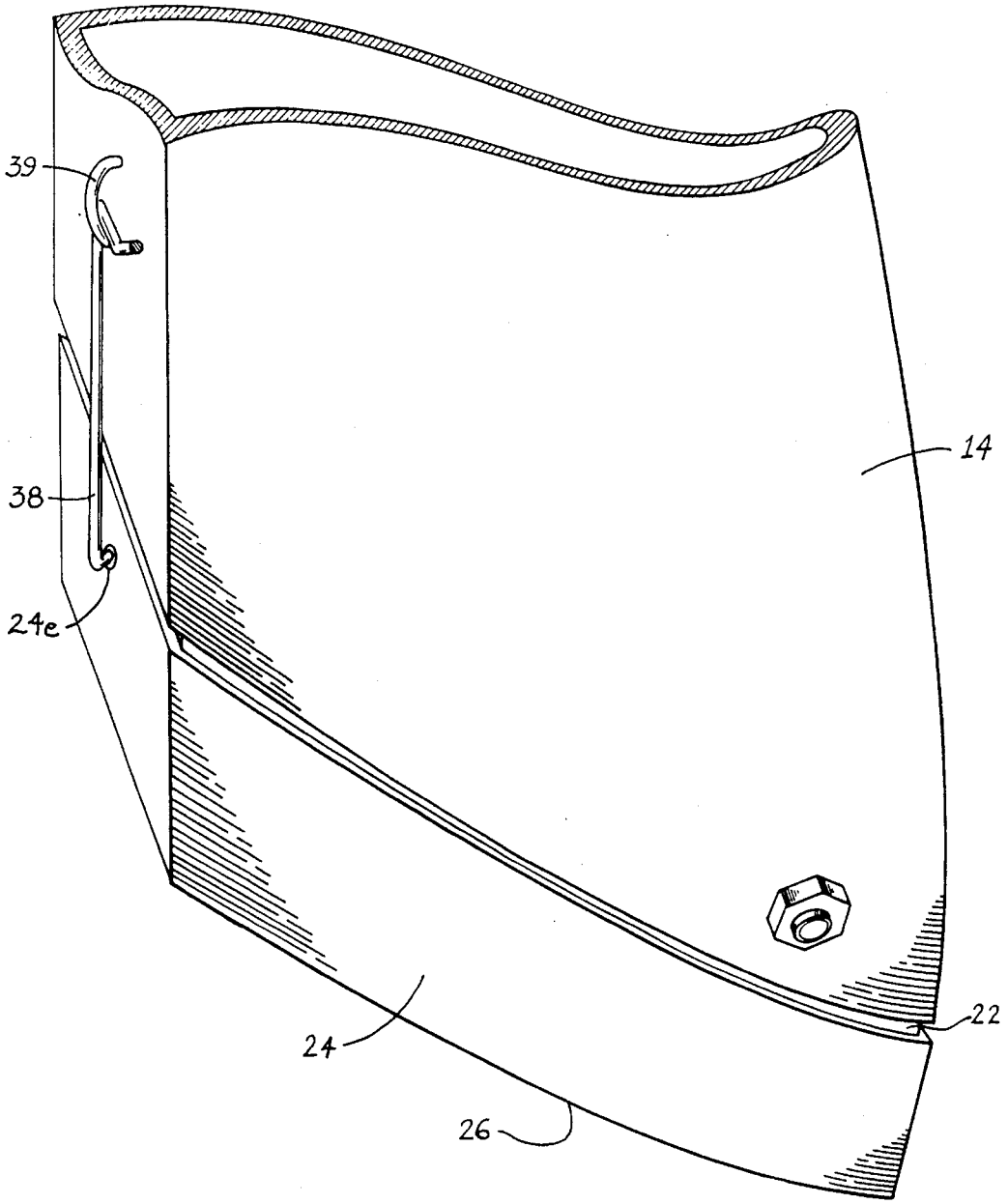

The sheath 24, being held in position in part by the contours of the mounting body 22, is secured to the handle 14, as indicated in FIG. 5, by means of a simple spring wire latch 38 bent in such a manner as to be inserted with one end into a small hole 24*e*, located in the approximate center of the rear side 24*c* of the sheath 24, shown in FIG. 2, and engaged at it's opposing end through a small spring wire hook 39 anchored near the distal end of the handle 14. As previously mentioned, the tongue 23 of the mounting body 22 fits inside the recessed distal end of the handle 14 and is attached therewith by means of a screw inserted through aligning holes on each side of the recessed distal end of the handle 14 and through the tongue 23 and held by a nut on the emergent end of the aforementioned screw, thus securing the mounting body 22 and the heater assembly 12 to the handle 14.

The heating element 20 comprising a thick film conductor material is composed in part of a metal, metal oxide or metal alloy or combinations thereof such as Conductor Paste Number C-4800 by Hereaus Cermalloy of West Conshohocken, Pa. The paste may be applied to the substrate by screen printing and firing at approximately 600° C. in clean dry air. For the purpose of the present invention any thick film conductor material having an electrical sheet resistivity that results in a power density in the range of 11.6–20 volts per square centimeter (75–130 watts per square inch) of delineated and fired conductor area, when a prespecified amount of electric power is supplied from an external electric source to the thick film conductor, is suitable.

The mounting body 22 may be molded from an epoxy such as Stycast® 2662 by Emerson and Cuming of Woburn, Mass., or machined or molded from any other material having similar properties that can endure operating temperatures in the range of 15° C.–250° C. without degradation. The epoxy may be cast in a mold such as silicone and cured at 175° C.–200° C. for approximately 6 hours.

The electrically insulating substrate 18 is approximately 1.0–1.8 millimeter in thickness and may comprise a material such as porcelain steel.

Theory of Operation

In defining generalized operating criteria for my low power sealer it was empirically determined that in order to achieve effective heating characteristics:

(a) power densities in the range of 11.6–20 watts per square centimeter (75–130 watts per square inch) of conductor area, excluding contact pads, are required, (b) the maximum percentage of thick film conductor area coverage of a substrate, excluding contact pads, is less than or equal to 30 percent of the total area of one planar face of the substrate in order to minimize the total power consumption from an external electrical source, (c) the minimum ratio of the thick film conductor line width, again excluding contact pads, to the thickness of the substrate is 0.65 in order to promote rapid, even heat transfer within the body of the substrate and between the substrate and a work surface, and (d) there exists intimate contact between the heater assembly and the work surface.

In the preferred embodiment of my low power sealer the total thick film conductor area coverage of the substrate, excluding contact pads, is approximately 25 percent of the area on one planar face. The ratio of the thick film conductor line width, excluding contact pads, to the thickness of the substrate is nominally unity. The power density is 11.6 watts per square centimeter (75 watts per square inch) of delineated and fired thick film conductor area, excluding contact pads, and my sealer is operable, but not limited to such operation, on 3.0 watts of power from an external electrical source.

The utilization of 3 watts of external power in a thick film conductor pattern having a power density of 11.6 watts per square centimeter (75 watts per square inch) of conductor area results in a total conductor area of 0.25 centimeter (0.04 square inch). By extrapolation, utilization of the previously stated higher power density of 20 watts per square centimeter (130 watts per square inch) of conductor in the above conductor area of 0.25 centimeter (0.04 square inch) requires an external power input of approximately 6 watts. Either case renders the heater assembly adaptable for battery operation.

Operation—FIGS. 1,2,3

In operation, as electric current is applied across the heating element 16 at terminal screws 34 and 34' contacts 32 and 32' and contact pads 28 and 30, the temperature of the heating element 20 rises rapidly due to the influx of electrical energy into a relatively small conductor area and resultant local high power density.

Effective heat distribution within the body of the substrate 18 from the heating element 20, and, heat transfer to the base **24*a* and the workface 26 are achieved because of the essentially matching dimensions of the line width of the heating element 20, excluding contact pads 28 and 30, and the thickness of the substrate 18, and because of the intimate contact existing between the substrate 18, the base 24*a* and hence the workface 26. Power consumption from the external electric source is minimized due to the reduced area coverage of the heating element 20 on the substrate 18. Heat loss to the surroundings other than through the workface 26 is reduced by the recess in the mounting body 22 permitting only necessary physical contact with the heater assembly 16, and, the low thermal conductivity composition of the mounting body 22**.

SUMMARY, RAMIFICATIONS AND SCOPE

Accordingly, the reader will see that my low power sealer offers several advantages, specifically: local high power density with effective heating characteristics within the heating element, efficient heat transfer between the heating element and the workface, reduced heat loss, and minimized electric power consumption. Furthermore, the heater assembly has the additional advantages that:

Direct current or battery operation is feasible; thus making the device portable;

Energy savings in alternating current powered devices can result; and

Construction is simple making my low power sealer readily producible at low cost.

While a preferred embodiment of my low power sealer has been shown and described, it will be realized that modifications may be made thereto without departing from the scope of the following claims.

I claim:

1. A portable hand held heating device for attaching, sealing or shrinking heat activated plastic or mylar film materials comprising a handle composed of an electrically insulating material and having a distal end with a recess, a proximal end with an opening and an internal cavity through the length of said handle and connecting said recess and said opening;

a heater assembly projecting from said distal end of said handle including a planar electrically insulating substrate having a heating element comprising a thick film conductor delineated in a U-shaped pattern and fired on one of its planar surfaces with its opposing planar surface adapted to apply heat to an opposing side of a workface by means of direct intimate contact to said opposing side of said workface, the perimeter of said substrate wherein being in the shape of an isosceles triangle with an elongated altitude and slightly convex curved equal sides, a vertex of said isosceles triangle corresponding to a frontal point of said substrate and an opposing base of said isosceles triangle corresponding to a trailing edge of said substrate, said U-shaped pattern having two enlarged conductor contact pads, one each contact pad being located on and forming a terminus of a U-leg, said contact pads being proximal to said trailing edge of said substrate, said heating element wherein, when delineated and fired, being of a suitable surface area and sheet resistivity to be adaptable for battery operation when electric power is supplied to said heating element from an external source of electrical energy;

means for enclosing said heater assembly to provide mechanical protection, and to effect efficient heat transfer from said heater assembly to said opposing side of said workface, said means being a sheet metal sheath including:

a horizontal planar base with a trailing edge and with an upper surface having a configuration the same as the configuration of said substrate and with dimensions slightly larger than the dimensions of said substrate and three surrounding upstanding sides of equal height, two of said sides being equal in length intersecting and mutually terminating at one of their ends to form a leading edge of said sheath immediately ahead of said frontal point of said substrate, a third rear side of said sheath rising from said trailing edge of said base of said sheath and mutually terminating with each of said two sides of equal length at their opposing ends from said leading edge, said leading edge and said rear side being swept back at identical angles relative to said frontal point of said substrate and to said trailing edge of said base, said upper surface of said base receiving placement with proper alignment of said substrate with said heating element face up and with said opposing planar surface of said substrate in intimate contact with said upper surface of said base, and with said workface comprising an opposing undersurface of said base;

means for attaching said heater assembly and said sheath to said distal end of said handle comprising a mounting body composed of an electrically insulating material of low thermal conductivity shaped so as to form fit inside of said sheath thus holding said leading edge of said sheath in proper position, said mounting body having a recess of sufficient size in an undersurface in order to rest atop said heater assembly while avoiding physical contact with said heating element, an upper surface of said mounting body being horizontal and planar, and having a mounting tongue projecting upward from said upper surface and fitting into said recess in said distal end of said handle, said mounting body held to said handle by means of a mounting screw inserted through a hole bored laterally through one side of said distal end, through said mounting tongue, and emerging from an opposing side of said distal end, said screw being secured by a nut on said opposing side, said means wherein further including a spring wire latch bent in a manner which allows one end of said latch to be inserted into a small hole located in an approximate center of a planar face of said rear side of said sheath with an opposing end of said latch bent so as to engage a spring wire hook anchored on said handle near said distal end of said handle thereby securing said sheath to said handle;

means for providing electrical continuity from said heater assembly to said external source of electrical energy comprising two metal leaf spring contacts, each said contact being bent near one of its ends to allow mounting to said mounting body with each said contact being mounted within said recess of said mounting body by means of a screw, one said screw for each said contact being inserted through a hole located in said end of each said contact and through a hole bored to accommodate each said screw through said recess in said undersurface of said mounting body and emerging at said upper surface of said mounting body and secured by a nut, an opposing unattached end of each said contact being bent near each said unattached end in a manner to permit alignment and to make electrical contact in registry with said contact pads of said thick film conductor, each said screw and said nut being connected to said external source of electrical energy by means of electrical leads extending through said recessed distal end, said internal cavity and said opening in said proximal end of said handle.

2. A portable hand held heating device for attaching, sealing or shrinking heat activated plastic or mylar film materials comprising a handle composed of an electrically insulating material and having a distal end with a recess, a proximal end with an opening and an internal cavity through the length of said handle and connecting said recess and said opening;

a heater assembly adaptable for battery operation projecting from said distal end including a planar electrically insulating substrate having a heating element comprising a thick film conductor delineated in a U-shaped pattern and fired on one of its planar surfaces with its opposing planar surface adapted to apply heat to an opposing side of a workface by means of direct intimate contact to said opposing side of said workface, the perimeter of said substrate wherein being in the shape of an isosceles triangle with an elongated altitude and slightly convex curved equal sides, a vertex of said isosceles triangle corresponding to a frontal point of said substrate and an opposing base of said isosceles triangle corresponding to a trailing edge of said substrate, said U-shaped pattern wherein having two enlarged conductor contact pads, one each contact pad being located on and forming a terminus of a U-leg, said contact pads being proximal to said trailing edge of said substrate, said U-shaped pattern wherein, excluding contact pads, having an electrical sheet resistivity and surface area resulting in a power density in a range of 11.6–20.0 watts per square centimeter (75–130 watts per square inch) when electric power in a range of 3.0–6.0 watts is supplied from an electric battery or equivalent electrical source to said heating element, said ranges wherein being suitable to cause sufficient heating of said heating element and said workface to permit said attaching, sealing and shrinking of said plastic and mylar films by said workface;

means for enclosing said heater assembly to provide mechanical protection, and to effect efficient heat transfer from said heater assembly to said opposing side of said workface, said means being a sheet metal sheath including:

a horizontal planar base with a trailing edge and with an upper surface having a configuration the same as the configuration of said substrate and with dimensions slightly larger than the dimensions of said substrate and three surrounding upstanding sides of equal height, two of said sides being equal in length intersecting and mutually terminating at one of their ends to form a leading edge of said sheath immediately ahead of said frontal point of said substrate, a third rear side of said sheath rising from said trailing edge of said base of said sheath and mutually terminating with each of said two sides of equal length at their opposing ends from said leading edge, said leading edge and said rear side being swept back at identical angles relative to said frontal point of said substrate and to said trailing edge of said base, said upper surface of said base receiving placement with proper alignment of said substrate with said heating element face up and with said opposing planar surface of said substrate in intimate contact with said upper surface of said base, and with said workface comprising an opposing undersurface of said base;

means for attaching said heater assembly and said sheath to said distal end of said handle comprising a mounting body composed of an electrically insulating material of low thermal conductivity shaped so as to form fit inside of said sheath thus holding said leading edge of said sheath in proper position, said mounting body having a recess of sufficient size in an undersurface in order to rest atop said heater assembly while avoiding physical contact with said heating element, and upper surface of said mounting body being horizontal and planar, and having a mounting tongue projecting upward from said upper surface and fitting into said recess in said distal end of said handle, said mounting body held to said handle by means of a mounting screw inserted through a hole bored laterally through one side of said distal end, through said mounting tongue, and emerging from an opposing side of said distal end, said screw being secured by a nut on said opposing side, said means wherein further including a spring wire latch bent in a manner which allows one end of said latch to be inserted into a small hole located in an approximate center of a planar face of said rear side of said sheath with an opposing end of said latch bent so as to engage a spring wire hook anchored on said handle near said distal end of said handle thereby securing said sheath to said handle;

means for providing electrical continuity from said heater assembly to said electrical source comprising two metal leaf spring contacts, each said contact being bent near one of its ends to allow mounting to said mounting body with each said contact being mounted within said recess of said mounting body by means of a screw, one said screw for each said contact being inserted through a hole located in said end of each said contact and through a hole bored to accomodate each said screw through said recess in said undersurface of said mounting body and emerging at said upper surface of said mounting body and secured by a nut, an opposing unattached end of each said contact being bent near each said unattached end in a manner to permit alignment and to make electrical contact in registry with said contact pads of said thick film conductor, each said screw and said nut being connected to said electrical source by means of electrical leads extending through said recessed distal end, said internal cavity and said opening in said proximal end of said handle.

* * * * *